US009014385B1

(12) United States Patent
Rosenthal

(10) Patent No.: US 9,014,385 B1
(45) Date of Patent: Apr. 21, 2015

(54) VENT DETECTION IN A HEARING ASSISTANCE DEVICE WITH A REAL EAR MEASUREMENT SYSTEM

(75) Inventor: Joyce Rosenthal, Golden Valley, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 370 days.

(21) Appl. No.: 13/564,151

(22) Filed: Aug. 1, 2012

(51) Int. Cl.
*H04R 29/00* (2006.01)
*H04R 25/00* (2006.01)

(52) U.S. Cl.
CPC ..... *H04R 25/30* (2013.01)

(58) Field of Classification Search
CPC ..... H04R 25/70; H04R 25/453; H04R 25/43; H04R 25/00; H04R 25/305; A61B 5/121; A61B 5/6815
USPC ..... 381/60, 312–331
See application file for complete search history.

(56) References Cited

U.S. PATENT DOCUMENTS 7,756,283 B2 7/2010 Bramslow
2010/0246869 A1 * 9/2010 Zhang et al. ..... 381/320

OTHER PUBLICATIONS

Andersen, Johnny, et al., "Open Fitting Measurement Method", (Feb. 25, 2009), 9 pgs.

* cited by examiner

*Primary Examiner* — Paul S Kim
(74) *Attorney, Agent, or Firm* — Schwegman Lundberg & Woessner, P.A.

(57) ABSTRACT

Disclosed herein, among other things, are methods and apparatus for vent detection in a hearing assistance device with a real ear measurement (REM) system. One aspect of the present subject matter relates to a method for estimating vent out effect for a hearing assistance device. A REM is performed to obtain a measured response for a hearing assistance device worn by a user. A first simulation of a real ear response is performed using an occluded hearing assistance device model. The REM is compared to the first simulation in a selected frequency range to determine a vent effect and a second simulation of the real ear response is performed using the determined vent effect. The REM is compared to the second simulation to derive gains that compensate for the shape and volume of the user's ear canal.

20 Claims, 7 Drawing Sheets

| Vent Size Category | Vent_Out Ranges (Vent_Out (dB) = Measurement – Model @300 Hz) |
|---|---|
| Occluded/Tight | -2 < vent_out |
| Small | -6 < vent_out < -2 |
| Medium | -12 < vent_out < -6 |
| Large | -20 < vent_out < -12 |
| Open | vent_out < -20 |

*Fig. 5*

VENT DETECTION IN A HEARING ASSISTANCE DEVICE WITH A REAL EAR MEASUREMENT SYSTEM

FIELD OF THE INVENTION

The present subject matter relates generally to hearing assistance devices, and in particular to vent detection in a hearing assistance device with a real ear measurement system.

BACKGROUND

Hearing assistance devices are electronic devices that provide signal processing functions such as noise reduction, amplification, and tone control. In many hearing assistance devices these and other functions can be programmed to fit the requirements of individual users. Performance of a user's hearing assistance device, while the device is in the user's ear, is difficult to measure. However, such measurements may enable better programming of a user's hearing assistance device because each user's ear is different.

Real ear measurement (REM) attempts to measure the actual sound produced by the hearing assistance device in an ear canal of a wearer of the device. Without real ear measurements, the fitting software of the hearing assistance device estimates the sound pressure level in the ear canal based on average ear geometry. This may be highly inaccurate.

What is needed in the art is an improved system for real ear measurement. The system for real ear measurement should be available for use with various hearing assistance devices, such as hearing aids.

SUMMARY

Disclosed herein, among other things, are methods and apparatus for vent detection in a hearing assistance device with a real ear measurement (REM) system.

One embodiment of the present subject matter relates to a method for estimating vent out effect for a hearing assistance device. A REM for a user's canal is performed to obtain a measured response for a hearing assistance device worn by the user. A first simulation of a real ear response is performed using an occluded hearing assistance device model. The REM is compared to the first simulation in a selected frequency range to determine a vent effect and a second simulation of the real ear response is performed using the determined vent effect. The REM is compared to the second simulation to derive gains that compensate for the shape and volume of the user's ear canal.

Another embodiment of the present subject matter relates to a method for performing a Real Ear Measurement (REM) for a user's canal using a hearing assistance apparatus with a receiver, a microphone, and a sound tube. A periodic signal is presented to the receiver to provide a calibrated sound in the user's ear canal, and the sound tube is used to capture a plurality of samples from the sound in the ear canal for each desired frequency to perform a Real Ear Measurement (REM) for the user's canal. The REM is compared to a simulation of a real ear response with an occluded hearing assistance apparatus and the measured response and the simulation are normalized in a selected frequency region to determine a vent effect. The simulation is recalculated using the new vent effect and the REM is compared to the recalculated simulation to derive gains that compensate for the shape and volume of the user's ear canal. The derived gains are stored in memory of the hearing assistance device, in various embodiments.

A further embodiment of the present subject matter relates to a hearing assistance apparatus for performing a Real Ear Measurement (REM) for a user's ear canal. The apparatus includes a receiver used to produce a sound, wherein the sound is received at the user's ear canal, a microphone, a sound tube used to transmit the sound from the ear canal to the microphone, and a processor. According to various embodiments, the hearing assistance apparatus is adapted to perform a Real Ear Measurement (REM) for a user's canal to obtain a measured response for a hearing assistance device worn by the user, perform a first simulation of a real ear response with an occluded hearing assistance device, compare the REM to the first simulation in a selected frequency range to determine a vent effect, perform a second simulation of the real ear response using the determined vent effect, and compare the REM to the second simulation to derive gains that compensate for the shape and volume of the user's ear canal.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

FIG. 5 illustrates a table showing mapped vent sizes based on vent out determined at 300 Hz, according to various embodiments.

DETAILED DESCRIPTION

Figure 1:
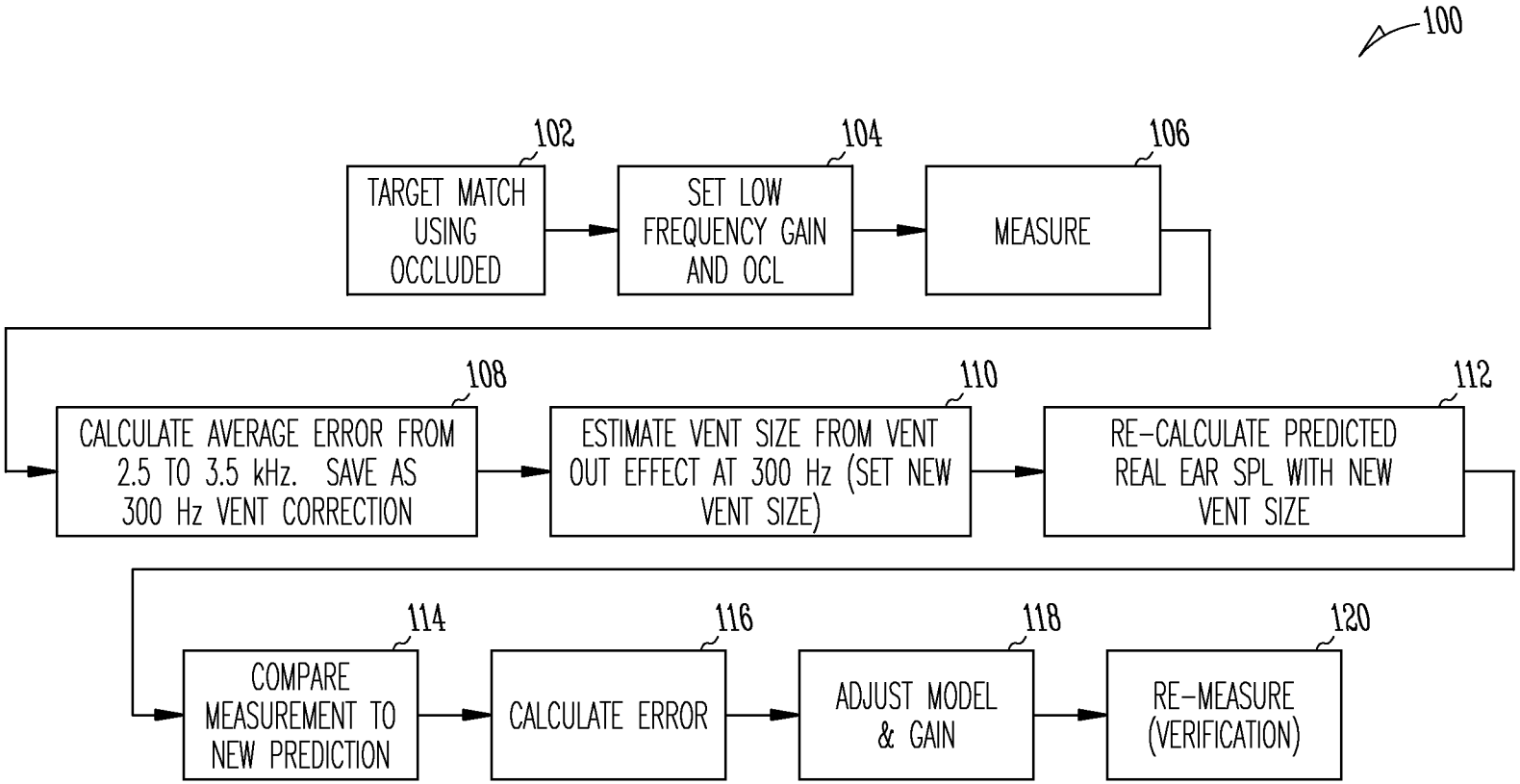
FIG. 1 illustrates a flow diagram of a method for determining vent size and model error, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various"

embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter relates generally to hearing assistance devices, and in particular to vent detection in a hearing assistance device with a real ear measurement system. The hearing assistance devices referred to herein include, but are not limited to hearing aids. One aspect of the present subject matter relates to a method for estimating vent out effect for a hearing assistance device. A REM for a user's canal is performed to obtain a measured response for a hearing assistance device worn by the user. A first simulation of a real ear response is performed using an occluded hearing assistance device model. The REM is compared to the first simulation in a selected frequency range to determine a vent effect and a second simulation of the real ear response is performed using the determined vent effect. The REM is compared to the second simulation to derive gains that compensate for the shape and volume of the user's ear canal.

The present subject matter enhances REM systems by detecting the 'vent out' component of a REM so that vent effects can be isolated from real ear (anatomical) effects for the purpose of a more accurate fitting. First, real ear measurement is compared to a simulation of a real ear response with an occluded hearing aid. The measured response and the simulation are normalized in a frequency region known to be immune to both vent effects and probe tube placement variability (using a data warehouse, which is a database used for reporting and analysis) before determining the extent to which the measurement deviates from the simulation in the low frequencies. Once the vent effect is estimated from the measurement, the simulation is recalculated using the new vent effect. The same measure is then compared again to the simulation, which is now using the correct vent. Any remaining deviation is attributed to differences between the patient's ear, and the simulated ear. Thus, the present subject matter provides a means for separating vent effects and 'real ear' effects so that each component can be treated accordingly in the simulation. Various embodiments of the present subject matter are used with hearing assistance devices having a microphone in the user's ear.

Previous attempted solutions to the vent effect problem included measuring the feedback path for tones using known level of noise out, and measuring strength of signal at microphone. A disadvantage of that solution is that it assumes all signal loss is due to vent out. However, some loss could be from variation in ear canal size, not just vent out. In addition, the signal would have to be loud so that it will not lose all of energy by the time it reaches microphone, and the noise has to be low (needs better SNR). The present subject matter can use a probe tube to measure real ear sound pressure level (SPL), and compares the measurement to predicted real ear SPL. The generated signal goes through a gain stage of hearing aid. The present subject matter is superior because it measures real ear SPL and separates the measurement into its component 'ear acoustics' and 'vent acoustics' components, in various embodiments. Benefits of the present subject matter are the same as those for doing real ear measurements—more accurate fitting—but now with the added benefit of handling low frequency gain correctly for the measured vent size. Thus, the user should be more satisfied with sound quality when the low frequency gain is adjusted to take vent effects into account.

FIG. 1 illustrates a flow diagram of a method 100 for determining vent size and model error, according to various embodiments of the present subject matter. At 102, a target match is performed using an occluded hearing assistance device model. Low frequency gain and OCL is set at 104, a REM is done at 106, and average error over a selected frequency range (approximately 2.5-3.5 kHz in this example) is calculated at 108. At 110, vent size is estimated and a predicted real ear SPL is calculated using the estimated vent size at 112. The REM is compared to the new prediction at 114, error is calculated at 116, and the model and gain are adjusted based on the error calculation at 118. In various embodiments, the REM is verified at 120 by re-measuring. Thus, FIG. 1 depicts the process for determining vent size and model error as part of the 'Measure and Match' procedure. Other frequency ranges can be used without departing from the scope of the present subject matter.

Before performing the REM, the present subject matter checks to make sure low frequency gain is set sufficiently high to avoid measurements in the noise floor for large-open vents. Based on preliminary measurements in a fairly quiet room, gain was set to ~25 dB in the two lowest bands (200, 500 Hz) in order to measure a vent out effect of ~25 dB at 300 Hz (65 dB SPL input). Note that for some lower gain hearing devices, this will be at or near the capacity of the device. In order to avoid saturation, output limits must be set to maximum. In various embodiments, the gains are set as follows:

1. Set 2 cc Coupler Gain at 200 Hz to at least 26 dB (if it's already higher, leave it alone)
2. Set 2 cc Coupler Gain at 500 Hz to at least 30 dB (If it's already higher, leave it alone)
3. Set output compression limits to maximum Other size couplers, frequencies, and gain values can be used without departing from the scope of the present subject matter. In various embodiments, vent-size is estimated by comparing measured response to occluded model. Therefore, vent size should be set to occluded.

4. Set vent size to occluded.

Figure 2A:
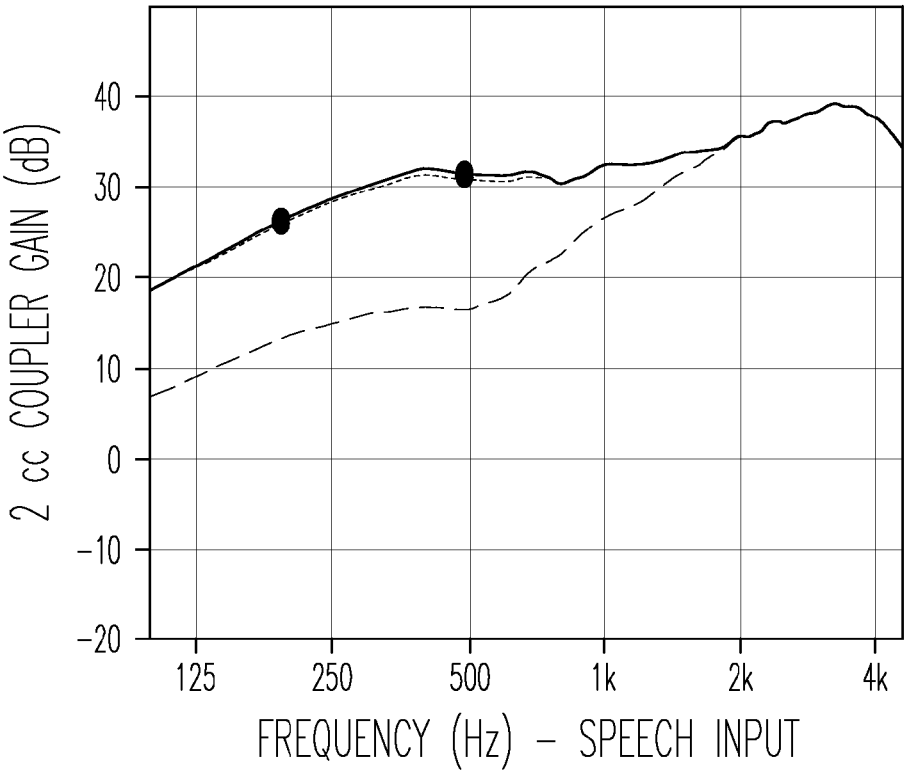
FIGS. 2A-2B illustrate an example of increased low frequency gain settings, according to various embodiments.
Figure 2B:
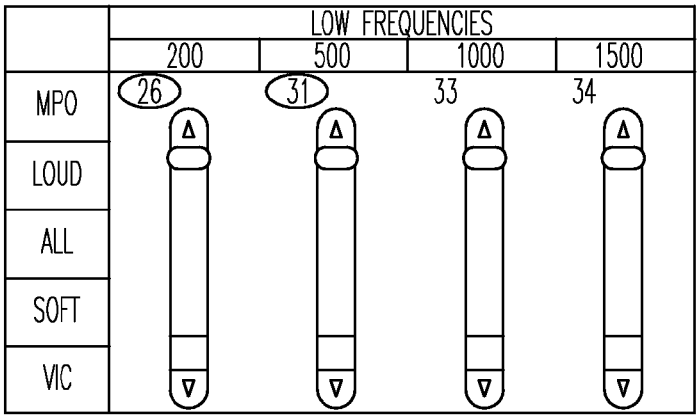

FIGS. 2A-2B illustrate an example of increased low frequency gain settings, according to various embodiments. In various embodiments, a stimulus is set at 65 SPL speech noise plus style-dependent microphone location effects, and the measurement (REM) is performed. The present subject matter uses the hearing aid to generate, and measure SPL in the ear canal. Since the sound generated comes from the receiver end of the hearing aid (i.e. sound is not entering the vent from the outside of the hearing aid), and the vent is typically left open, the resulting measurement can be used to determine a vent-out effect. Frequencies above 2.5 kHz are practically immune to vent out effects, and frequencies below ~3.5 kHz immune to probe tube location effects (for 'normal' probe tube placement variability). Therefore, error in this range is used to determine an overall 'level correction' to be applied to the measurement before it is compared directly to the model to estimate the vent out effect. This effectively removes model error unrelated to vent effects so that vent out (and vent size) can be more accurately estimated.

Figure 3:
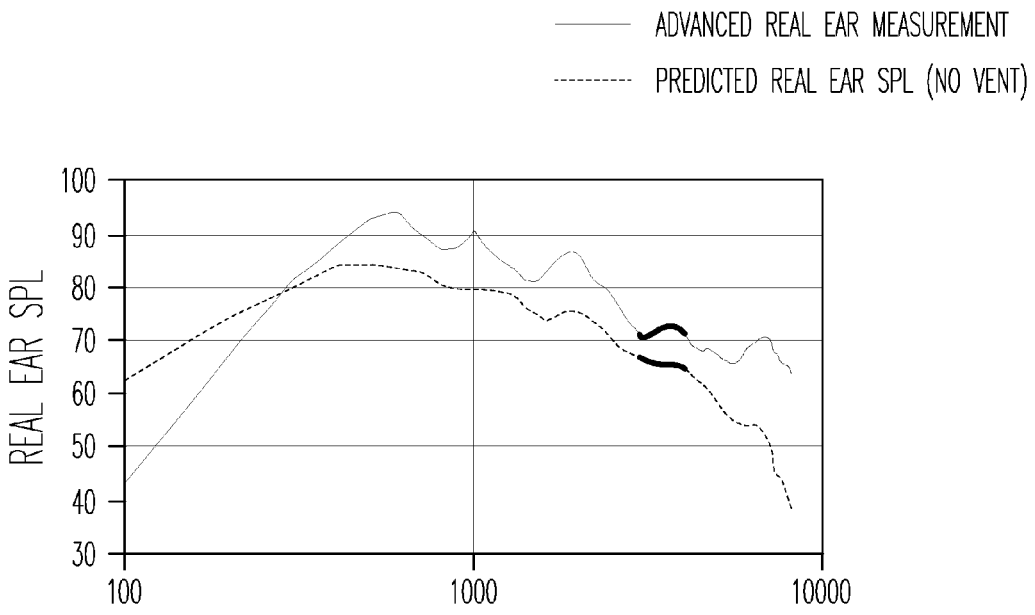
FIG. 3 illustrates a graphical diagram showing a comparison of a REM to a simulation using an occluded hearing assistance device model, according to various embodiments.

FIG. 3 illustrates a graphical diagram showing a comparison of a REM to a simulation using an occluded hearing assistance device model, according to various embodiments. The highlighted region is from approximately 2500 to 3400 Hz, inclusive. In various embodiments, level correction at 300 Hz=average error from 2500 to 3400 inclusive (2500, 2600, 2700, 2800, 2900, 3000, 3100, 3200, 3300, 3400), where Error(f)=Measurement(f)−Model(f). Other ranges and frequencies can be used without departing from the scope of the present subject matter.

Figure 4:
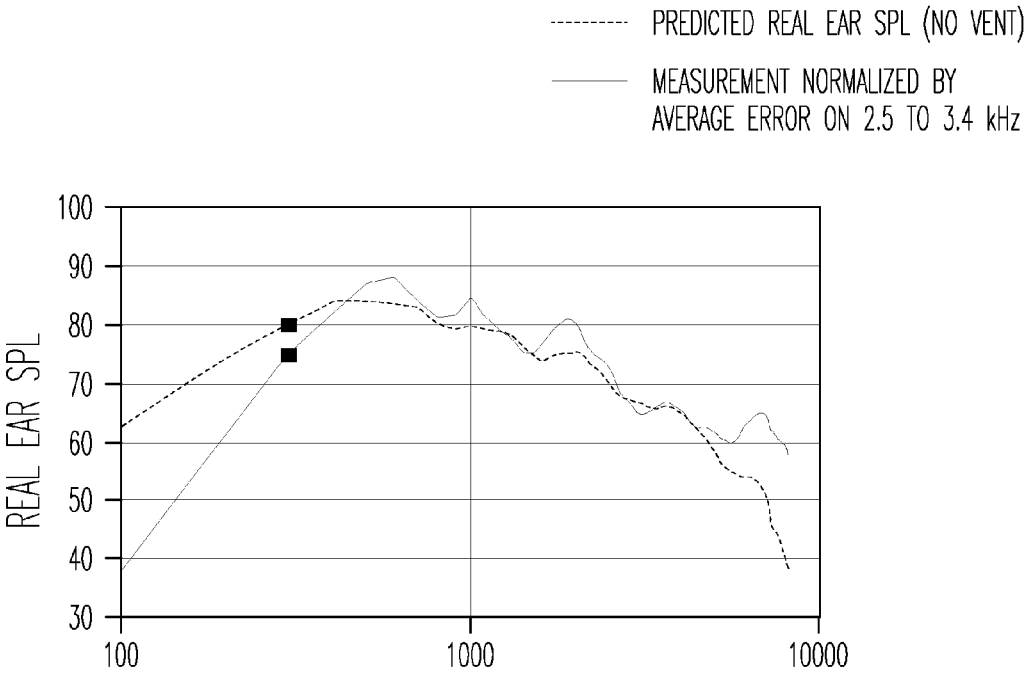
FIG. 4 illustrates a graphical diagram showing a comparison of a normalized REM to a simulation using an occluded hearing assistance device model, according to various embodiments.

FIG. 4 illustrates a graphical diagram showing a comparison of a normalized REM to a simulation using an occluded hearing assistance device model, according to various embodiments. In various embodiments, the measurement (300 Hz)−Model (300 Hz)$_{corrected}$=vent out at 300 Hz (in this example, −5 dB). Vent out at 300 Hz is mapped to one of five vent size categories according to the table depicted in FIG. 5. (In this example, vent out of −5 dB maps to SMALL vent size). Other ranges for vent size categories, or more precise vent out corrections without discrete vent size categories, can be used without departing from the scope of the present subject matter.

Figure 6:
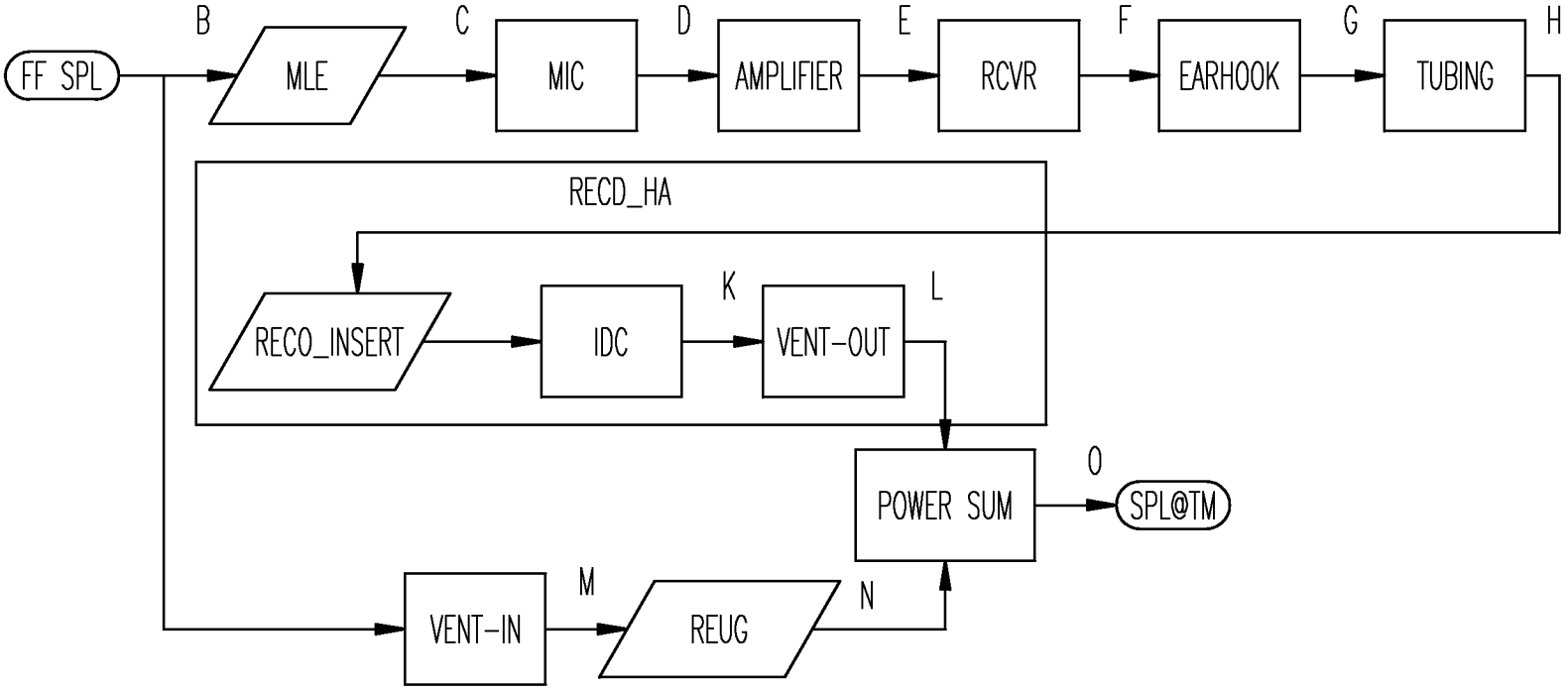
FIG. 6 illustrates a block diagram showing signal paths in a system including a hearing assistance device, according to various embodiments of the present subject matter.
Figure 7:
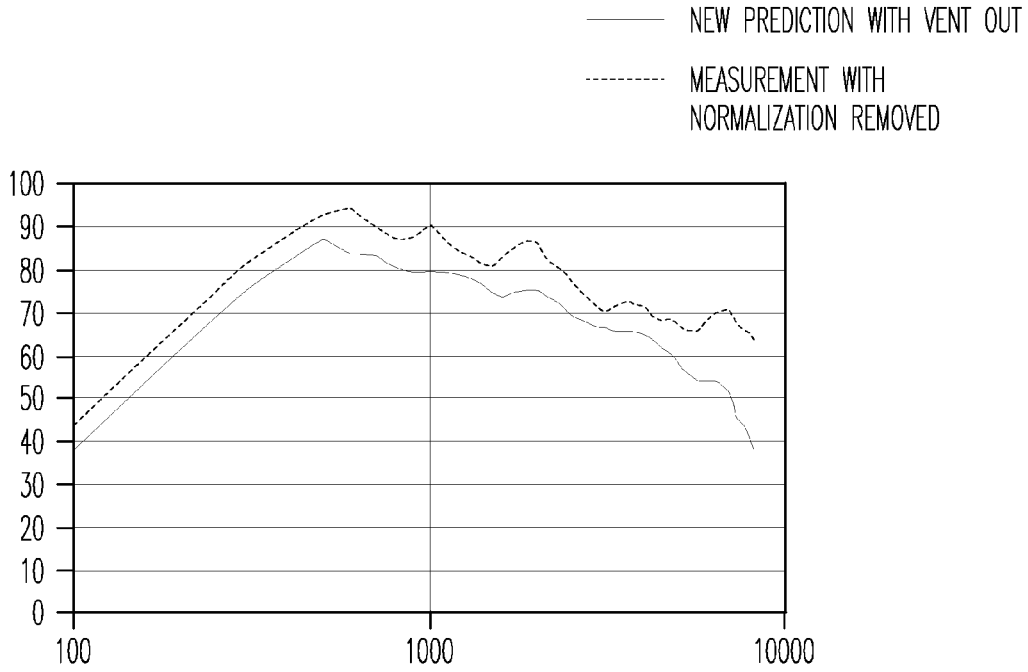
FIG. 7 illustrates a graphical diagram showing a comparison of a REM to a simulation using the determined vent out, according to various embodiments.
Figure 8:
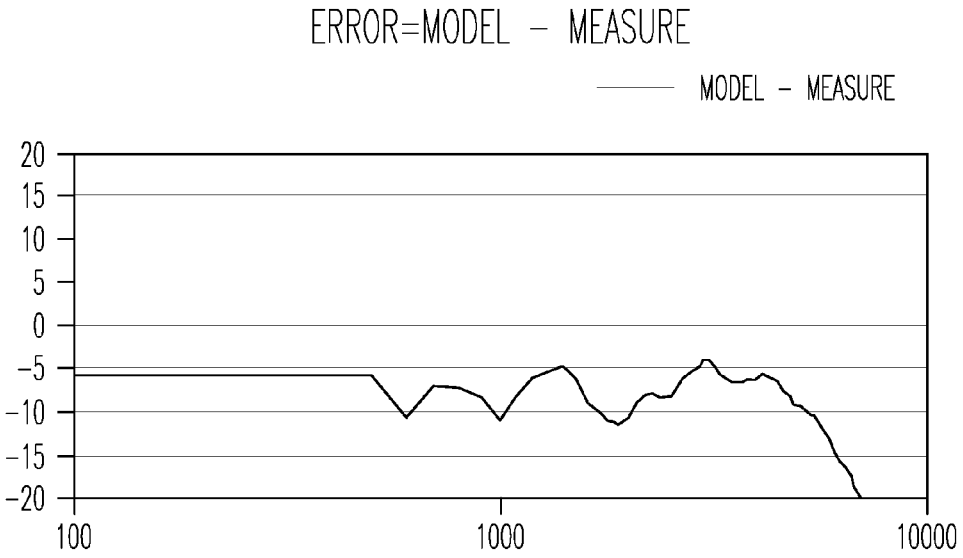
FIG. 8 illustrates a graphical diagram showing the error determined by comparing the model to measured SPL, according to various embodiments.

FIG. 6 illustrates a block diagram showing signal paths in a system including a hearing assistance device, according to various embodiments of the present subject matter. In various embodiments, the combined effects of RECD_insert (real ear coupler difference using an insert foam tip in the ear), IDC (insertion depth correction), and vent out (all quantities combined are called "RECD_HA") are measured simultaneously by the present subject matter. For modeling purposes, it is useful to try to separate the measured vent out effect from the RECD_insert+IDC components of the measurement. Once measured, the vent size used for modeling vent-out (and corresponding vent-in) effects can be changed, if needed, with the remaining model error presumed to be primarily RECD_insert and IDC-related. Following is a description of a process by which the real ear measurement and modeled response should be compared in order to determine the error in the quantity RECD_HA:

1. Re-calculate SPL at node L, this time using new vent size category for vent_out. (same hearing aid settings as for measure 1 of measure and match)
2. Compare model to measure.
   Assuming vent_out measured and vent_out modeled match reasonably well at this point, the difference between measure and model should be primarily due to error in the quantity 'recd_insert+IDC'. FIG. 7 illustrates a graphical diagram showing a comparison of a REM to a simulation using the determined vent out, according to various embodiments.
3. Calculate error.
   FIG. 8 illustrates a graphical diagram showing the error determined by comparing the model to measured SPL, according to various embodiments.

Figure 9:
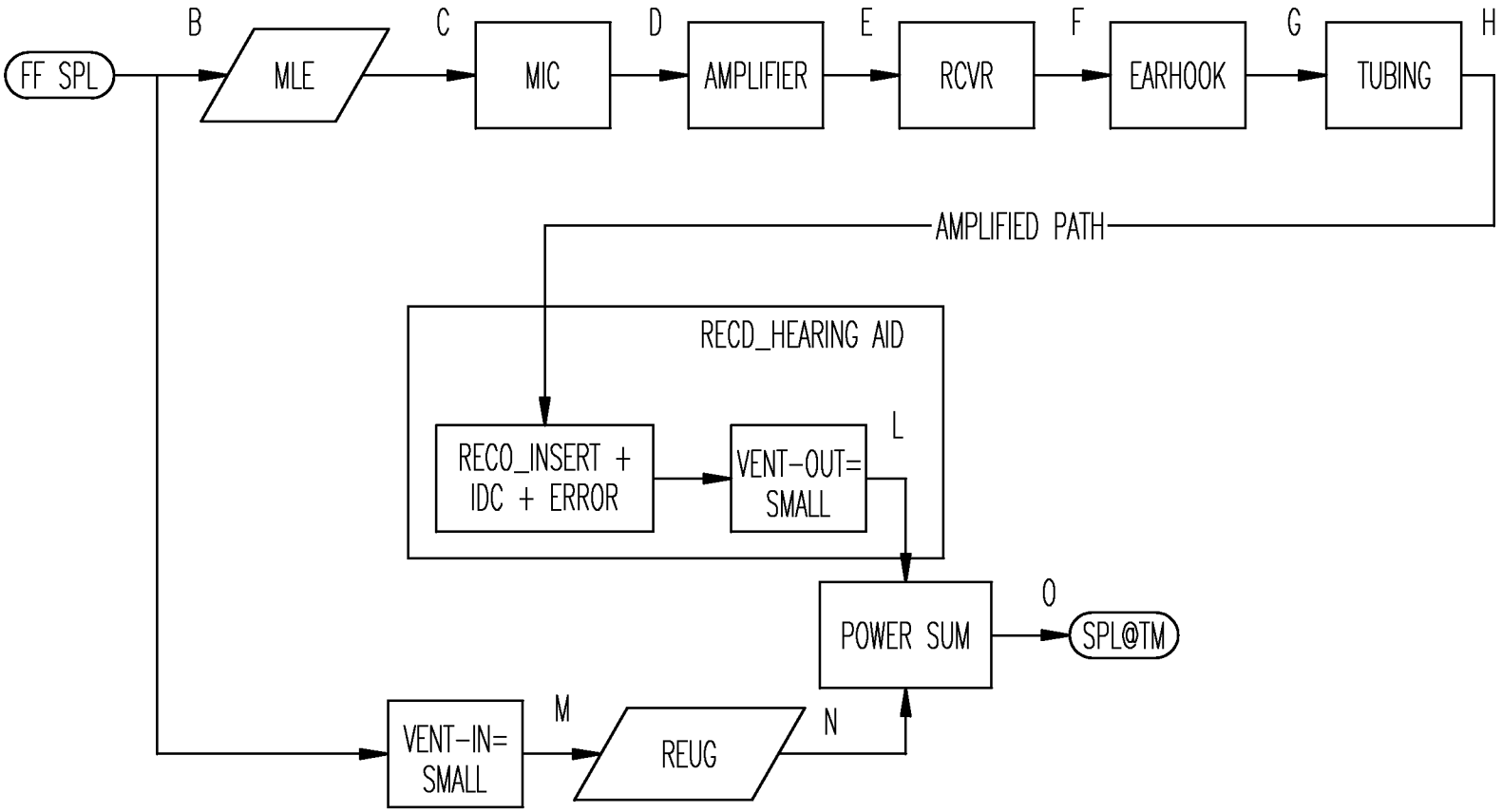
FIG. 9 illustrates a block diagram showing signal paths in a system including a hearing assistance device, according to various embodiments of the present subject matter.

FIG. 9 illustrates a block diagram showing signal paths in a system including a hearing assistance device, according to various embodiments of the present subject matter. The new REC_HA is equal to RECD insert plus IDC plus error plus vent out, in various embodiments.

Various embodiments of the present subject matter support wireless communications with a hearing assistance device. In various embodiments the wireless communications can include standard or nonstandard communications. Some examples of standard wireless communications include link protocols including, but not limited to, Bluetooth™, IEEE 802.11 (wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. Although the present system is demonstrated as a radio system, it is possible that other forms of wireless communications can be used such as ultrasonic, optical, and others. It is understood that the standards which can be used include past and present standards. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new future standards may be employed without departing from the scope of the present subject matter.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. Processing electronics include a controller or processor, such as a digital signal processor (DSP), in various embodiments. Other types of processors may be used without departing from the scope of this disclosure. Antenna configurations may vary and may be included within an enclosure for the electronics or be external to an enclosure for the electronics. Thus, the examples set forth herein are intended to be demonstrative and not a limiting or exhaustive depiction of variations.

The present subject matter can be used for a variety of hearing assistance devices, including but not limited to, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method, comprising:

performing a Real Ear Measurement (REM) for a user's canal to obtain a measured response for a hearing assistance device worn by the user;

performing a first simulation of a real ear response using an occluded hearing assistance device model;

comparing the REM to the first simulation in a selected frequency range to determine a vent effect;

performing a second simulation of the real ear response using the determined vent effect; and comparing the REM to the second simulation to derive gains that compensate for the shape and volume of the user's ear canal.

2. The method of claim 1, wherein the selected frequency range includes a range from approximately 2500-3400 Hz.

3. The method of claim 1, further comprising performing a further REM to verify the derived gains.

4. The method of claim 1, wherein determining the vent effect includes determining a vent size.

5. The method of claim 2, wherein comparing the REM to the first simulation over a frequency range includes comparing the REM to the first simulation from approximately 2500 to 3400 for normalization purposes then determining level correction at 300 Hz.

6. The method of claim 4, further comprising mapping vent size into a size category.

7. The method of claim 6, wherein mapping vent size into a size category includes mapping vent size into one of five predetermined categories.

8. A method for performing a Real Ear Measurement (REM) using a hearing assistance apparatus with a receiver, a microphone, and a sound tube, comprising:

presenting a signal to the receiver to provide an expected sound in a user's ear canal;

using the sound tube to capture a sound pressure level in the ear canal for each desired frequency;

comparing the REM to a simulation of the expected sound with an occluded hearing assistance apparatus;

normalizing the measured response to the simulation in a selected frequency region to determine a vent effect;

recalculating the simulation using the new vent effect;

comparing the REM to the recalculated simulation to derive gains that compensate for the shape and volume of the user's ear canal; and storing the derived gains in memory of the hearing assistance device.

9. The method of claim 8, wherein the selected frequency range for normalization includes a range from approximately 2500-3400 Hz.

10. The method of claim 8, further comprising performing a further REM to verify the derived gains.

11. The method of claim 8, wherein determining the vent effect includes determining a vent size.

12. The method of claim 9, wherein comparing the REM to the first simulation over a frequency range from approximately 2500 to 3400 for normalization then determining level correction at 300 Hz.

13. The method of claim 11, further comprising mapping vent size into a size category.

14. The method of claim 13, wherein mapping vent size into a size category includes mapping vent size into one of five predetermined categories.

15. A hearing assistance apparatus for performing a Real Ear Measurement (REM) for a user's ear canal, comprising:

a receiver used to produce a sound, wherein the sound is received at the user's ear canal;

a microphone;

a sound tube used to deliver the sound from the ear canal to the microphone; and a processor;

wherein the hearing assistance apparatus is adapted to:

perform a Real Ear Measurement (REM) for a user's canal to obtain a measured response for a hearing assistance device worn by the user;

perform a first simulation of a real ear response with an occluded hearing assistance device;

compare the REM to the first simulation in a selected frequency range to determine a vent effect;

perform a second simulation of the real ear response using the determined vent effect; and compare the REM to the second simulation to derive gains that compensate for the shape and volume of the user's ear canal.

16. The hearing assistance apparatus of claim 15, wherein the processor is programmed to perform a further REM to verify the derived gains.

17. The hearing assistance apparatus of claim 15, further comprising a probe microphone.

18. The hearing assistance apparatus of claim 15, wherein the selected frequency range for normalization includes a range from approximately 2500-3400 Hz, and further includes a calculated vent out effect at 300 Hz.

19. The hearing assistance apparatus of claim 15, wherein the processor includes a digital signal processor.

20. The hearing assistance apparatus of claim 15, wherein the processor is programmed to determine vent size.

* * * * *

UNITED STATES PATENT AND TRADEMARK OFFICE

CERTIFICATE OF CORRECTION

PATENT NO. : 9,014,385 B1
APPLICATION NO. : 13/564151
DATED : April 21, 2015
INVENTOR(S) : Joyce Rosenthal It is certified that error appears in the above-identified patent and that said Letters Patent is hereby corrected as shown below:

On the Title page, in item (57), in "Abstract", in column 2, line 3, delete "real ear measurement" and insert --Real Ear Measurement--, therefor Signed and Sealed this
Ninth Day of February, 2016

Michelle K. Lee

Michelle K. Lee
*Director of the United States Patent and Trademark Office*